US010623857B2

(12) United States Patent
Christoph et al.

(10) Patent No.: US 10,623,857 B2
(45) Date of Patent: Apr. 14, 2020

(54) INDIVIDUAL DELAY COMPENSATION FOR PERSONAL SOUND ZONES

(71) Applicant: HARMAN BECKER AUTOMOTIVE SYSTEMS GmbH, Karlsbad-Ittersbach (DE)

(72) Inventors: Markus E. Christoph, Straubing (DE); Matthias Kronlachner, Regensburg (DE)

(73) Assignee: Harman Becker Automotive Systems GmbH, Karlsbad-Ittersbach (DE)

( * ) Notice: Subject to any disclaimer, the term of this patent is extended or adjusted under 35 U.S.C. 154(b) by 228 days.

(21) Appl. No.: 15/359,893

(22) Filed: Nov. 23, 2016

(65) Prior Publication Data

US 2018/0146290 A1 May 24, 2018

(51) Int. Cl.

| | |
|---|---|
| ***H04R 3/12*** | (2006.01) |
| ***H04R 3/04*** | (2006.01) |
| ***H04S 7/00*** | (2006.01) |

(52) U.S. Cl.

CPC ..... *H04R 3/12* (2013.01); *H04R 3/04* (2013.01); *H04R 2499/13* (2013.01); *H04S 7/307* (2013.01)

(58) Field of Classification Search

None

See application file for complete search history.

(56) References Cited

U.S. PATENT DOCUMENTS

2008/0045140 A1* 2/2008 Korhonen ..... H04M 1/7253 455/3.06
2015/0289059 A1* 10/2015 Christoph ..... H04S 7/301 381/97
2015/0350804 A1* 12/2015 Crockett ..... H04R 5/02 381/307
2017/0238118 A1* 8/2017 Bahne ..... H04S 7/302 700/94

OTHER PUBLICATIONS

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519. (Year: 2003).*

* cited by examiner

*Primary Examiner* — Kenny H Truong
(74) *Attorney, Agent, or Firm* — Brooks Kushman P.C.

(57) ABSTRACT

A plurality of speakers are arranged within a listening space. An audio processor is configured to generate a plurality of sound zones within the listening space using the plurality of speakers. The audio processor is programmed to create zone audio signals to generate at least one bright zone in the plurality of sound zones, perform individual delay compensation to the zone audio signals to add additional delay to a subset of the plurality of speakers, the additional delay defined to adjust acoustical output from the subset of the plurality of speakers to match an amount of delay of a most-delayed speaker of the plurality of speakers to the plurality of sound zones, and transmit the zone audio signals to reproduce the at least one bright zone by the plurality of speakers.

20 Claims, 16 Drawing Sheets

INDIVIDUAL DELAY COMPENSATION FOR PERSONAL SOUND ZONES

TECHNICAL FIELD

Aspects disclosed herein generally relate to individual delay compensation performed for personal sound zones.

BACKGROUND

Sound zones may be generated using speakers arrays and audio processing techniques providing acoustic isolation. Using such a system, different sound material may be reproduced in different zones with limited interfering signals from adjacent sound zones. In order to realize the sound zones, a system may be designed to adjust the response of multiple sound sources to approximate the desired sound field in the reproduction region. A large variety of concepts concerning sound field control have been published, with different degrees of applicability to the generation of sound zones.

SUMMARY

In one or more illustrative embodiments, a system includes a plurality of speakers arranged within a listening space; and a signal processor configured to generate a plurality of sound zones within the listening space using the plurality of speakers, the signal processor programmed to create zone audio signals to generate at least one bright zone in the plurality of sound zones, perform individual delay compensation to the zone audio signals to add additional delay to a subset of the plurality of speakers, the additional delay defined to adjust acoustical output from the subset of the plurality of speakers to match an amount of delay of a most-delayed speaker of the plurality of speakers to the plurality of sound zones, and send the zone audio signals to the plurality of speakers for reproduction of the at least one bright zone.

In one or more illustrative embodiments, a method includes receiving audio input channels from an audio source to be provided to a plurality of speakers arranged within a listening space to support a plurality of sound zones; providing zone audio signals to generate at least one bright zone in the plurality of sound zones; performing individual delay compensation to the zone audio signals to add additional delay to a subset of the plurality of speakers, the additional delay adjusting acoustical output from the subset of the plurality of speakers to match an amount of delay of a most-delayed speaker of the plurality of speakers to the plurality of sound zones; and transmitting the zone audio signals for reproduction by the plurality of speakers.

In one or more illustrative embodiments, a computer-program product is embodied in a non-transitory computer-readable medium. The computer-program product includes instructions to cause an audio processor to receive audio input channels from an audio source to be provided to a plurality of speakers arranged within a listening space to provide a plurality of sound zones; create zone audio signals to generate at least one bright zone in the plurality of sound zones; perform individual delay compensation to the zone audio signals to add additional delay to a subset of the plurality of speakers, the additional delay being defined to adjust an acoustical output from the subset of the plurality of speakers to match an amount of delay of a most-delayed speaker of the plurality of speakers to the plurality of sound zones; and transmit the zone audio signals for reproduction by the plurality of speakers.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
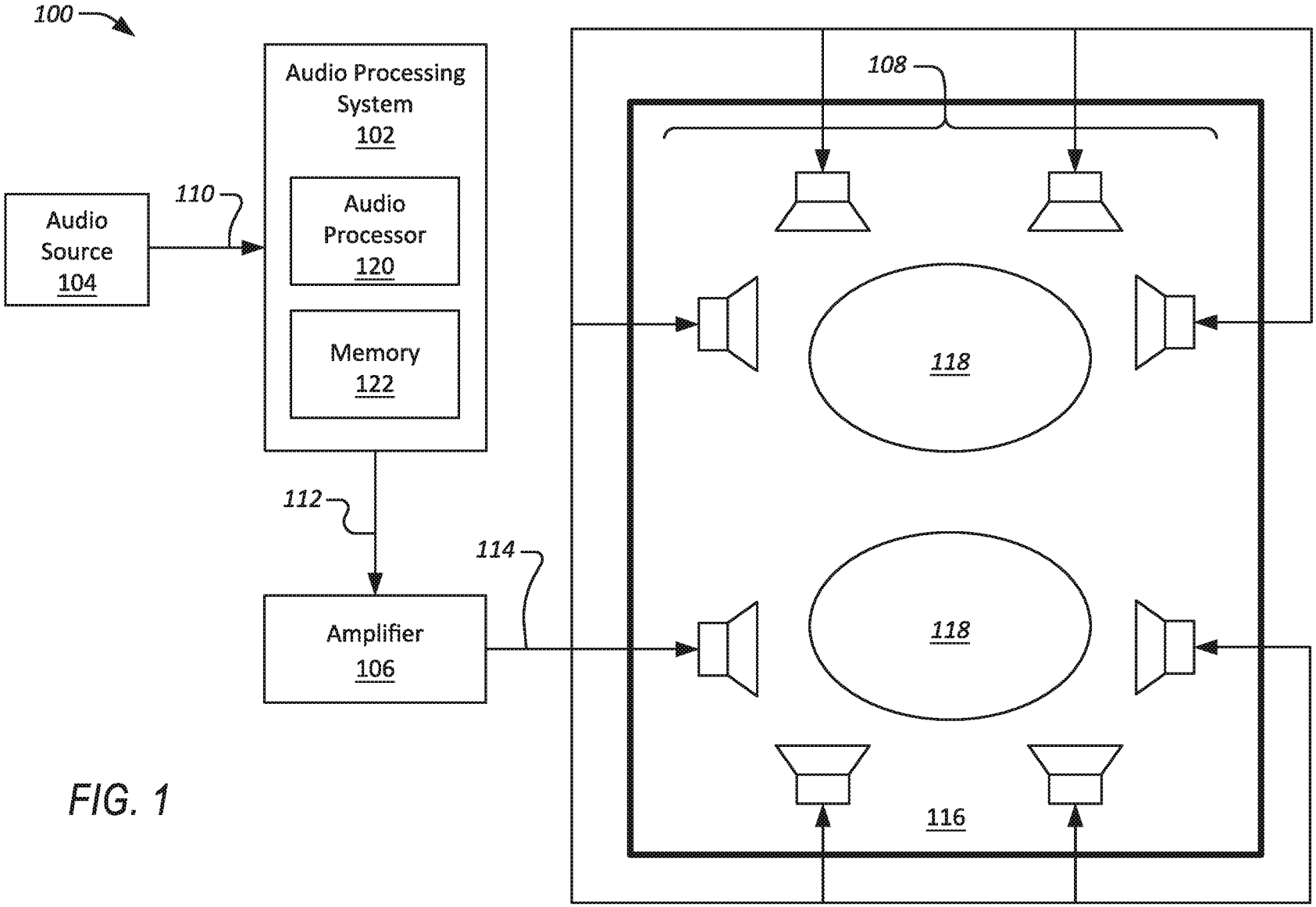
FIG. 1 illustrates an example sound system having multiple individual sound zones.

FIG. 1 is an example audio system 100 having multiple sound zones 118 located within a listening space 116. The audio system 100 includes an audio processing system 102, at least one audio source 104 of content, at least one amplifier 106, and a plurality of speakers 108. The audio processing system 102 receives audio input signals 110 from the audio source 104, utilizes an audio processor 120 and memory 122 to process the audio input signals 110 into audio output signals 112, and provides the audio output signals 112 to the amplifier 106 to drive the speakers 108. Example audio systems 100 include a vehicle audio system, a stationary consumer audio system such as a home theater system, an audio system for a multimedia system such as a movie theater or television, a multi-room audio system, a public address system such as in a stadium or convention center, an outdoor audio system, or an audio system in any other venue in which it is desired to reproduce audible audio sound.

The audio source 104 may be any form of one or more devices capable of generating and outputting different audio signals on at least one channel. Examples of the audio source 104 may include a media player, such as a compact disc, video disc, digital versatile disk (DVD), or BLU-RAY disc player, a video system, a radio, a cassette tape player, a wireless or wired communication device, a navigation system, a personal computer, a codec such as an MP3 player or an IPOD™ or any other form of audio related device capable of outputting different audio signals on at least one channel.

The audio source 104 of content produces one or more audio signals on respective audio input channels 110 from source material such as pre-recorded audible sound. The audio signals may be audio input signals produced by the audio source 104 of content, and may be analog signals based on analog source material, or may be digital signals based on digital source material. Accordingly, the audio source 104 of content may include signal conversion capability such as analog-to-digital or digital-to-analog converters. In one example, the audio source 104 of content may produce stereo audio signals consisting of two substantially different audio signals representative of a right and a left channel provided on two audio input channels 110. In another example, the audio source 104 of content may produce greater than two audio signals on greater than two audio input channels 110, such as 5.1 surround, 6.1 surround, 7.1 surround, 12.4 surround, ATMOS® audio including up to 34 audio channels, or any other number of different audio signals produced on a respective same number of audio input channels 110.

The amplifier 106 may be any circuit or standalone device that receives audio input signals of relatively small magnitude, and outputs similar audio signals of relatively larger magnitude. One or more audio input signals 110 may be received by the amplifier 106 on two or more audio output channels 112 and output on two or more speaker connections 114. In addition to amplification of the amplitude of the audio signals, the amplifier 106 may also include signal processing capability to shift phase, adjust frequency equalization, adjust delay or perform any other form of manipulation or adjustment of the audio signals in preparation for being provided to the speakers 108. The signal processing functionality may additionally or alternately occur within the audio processing system 102. Also, the amplifier 106 may include capability to adjust volume, balance and/or fade of the audio signals provided on the speaker connections 114. In an alternative example, the speakers 108 may include the amplifier, such as when the speakers 108 are self-powered, also known as active speakers.

The speakers 108 may be positioned in a listening space 116 such as a room, a vehicle, or in any other space where the speakers 108 can be operated. The speakers 108 may be any size and may operate over any range of frequency. Each speaker connection 114 may supply a signal to drive one or more speakers 108. Each of the speakers 108 may include a single transducer, or in other cases multiple transducers, which are, e.g., passively coupled. The speakers 108 may also be operated in different frequency ranges such as a subwoofer, a woofer, a midrange, and a tweeter. Multiple speakers 108 may be included in the audio system 100.

The listening space 116 may be divided into multiple sound zones 118. The sound zones 118 refer to rooms or areas in which sound is distributed via the speakers 108. A bright zone is a sound zone 118 in which sound material is being reproduced. A dark zone is a sound zone 118 in which sound material is not being reproduced. Using sound zones 118, multiple areas of different sound material may be simultaneously reproduced inside the listening space 116, without the use of physical separations or headphones.

The audio processing system 102 may receive the audio input signals 110 from the audio source 104 of content on the audio input channels 110. Following processing, the audio processing system 102 provides processed audio signals on the audio output channels 112 to the amplifier 106. The audio processing system 102 may be a separate unit or may be combined with the audio source 104 of content, the amplifier 106 and/or the speakers 108. Also, in other examples, the audio processing system 102 may communicate over a network or communication bus to interface with the audio source 104 of content, the audio amplifier 106, the speakers 108 and/or any other device or mechanism (including other audio processing systems 102).

One or more audio processors 120 may be included in the audio processing system 102. The audio processors 120 may be one or more computing devices capable of processing audio and/or video signals, such as a computer processor, microprocessor, a digital signal processor, or any other device, series of devices or other mechanisms capable of performing logical operations. The audio processors 120 may operate in association with a memory 122 to execute instructions stored in the memory. The instructions may be in the form of software, firmware, computer code, or some combination thereof, and when executed by the audio processors 120 may provide the functionality of the audio processing system 102. The memory 122 may be any form of one or more data storage devices, such as volatile memory, non-volatile memory, electronic memory, magnetic memory, optical memory, or any other form of data storage device. In addition to instructions, operational parameters and data may also be stored in the memory 122. The audio processing system 102 may also include electronic devices, electro-mechanical devices, or mechanical devices such as devices for conversion between analog and digital signals, filters, a user interface, a communications port, and/or any other functionality to operate and be accessible to a user and/or programmer within the audio system 100.

During operation, the audio processing system 102 receives and processes the audio input signals 110. In an example, during processing of the audio input signals 110, the audio processor 120 receive audio input channels 110, receives zone information indicative of which audio source 104 to play in which sound zones 118, develops the audio input channels 110 into audio output channels 112 to be provided to the sound zones 118, and provides the audio output channels 112 to the amplifier 106 to drive the speakers 108.

An aspect of using personal sound zones 118 in an automotive environment is that the locations of the sound zones 118 may be identified in advance. For instance, the sound zones 118 may be given by the potential head positions at different seats. Assuming a vehicle with four seat positions, which can be regarded as one example case, some speakers 108 are in close proximity to each of those potential personal sound zones 118 while other speakers 108 are much further away. This variation in the delay time between speakers 108 and sound zones 118 may lead to acoustical artifacts, which may be perceivable especially at the bright zones. Cutting out common delay (or bulk delay) defined by the most adjacent speaker 108 to all considered sound zones 118 of all room impulse responses (RIRs) reduces the perception of acoustical artifacts. With removal of the bulk delay, the acoustical effect then depends on the setup of the speakers 108, such that the more remaining delay variation exists between the speakers 108, the less the effect. This holds especially true, if speakers 108 are installed very close to the potential sound zones 118, such as speakers 108 in the headrests and/or at the headliner above each zone.

It may be desired to have speakers 108 close to potential personal sound zones 118 to enlarge the useful spectral bandwidth of an ISZ system 100. Thus, a system 100 may face conflicting requirements between spectral bandwidth and speaker 108 delay. To solve this conflict, individual delay compensation may be applied to the RIRs to the bright zone(s) prior to the calculation of the ISZ filter sets. The resulting ISZ filter may accordingly show improved acoustical performance. However, the resulting ISZ filter for the individual delay compensation is also configured to be time delayed, corresponding to a previously-applied channel-dependent individual delay reduction, before being allowed to be utilized. Thereby, the positive acoustical performance does not change. Further, the final resulting ISZ filter shows substantially the same acoustical contrast as if calculated without the application of individual delay compensation. Further details of the individual delay compensation are discussed in detail below.

Figure 2:
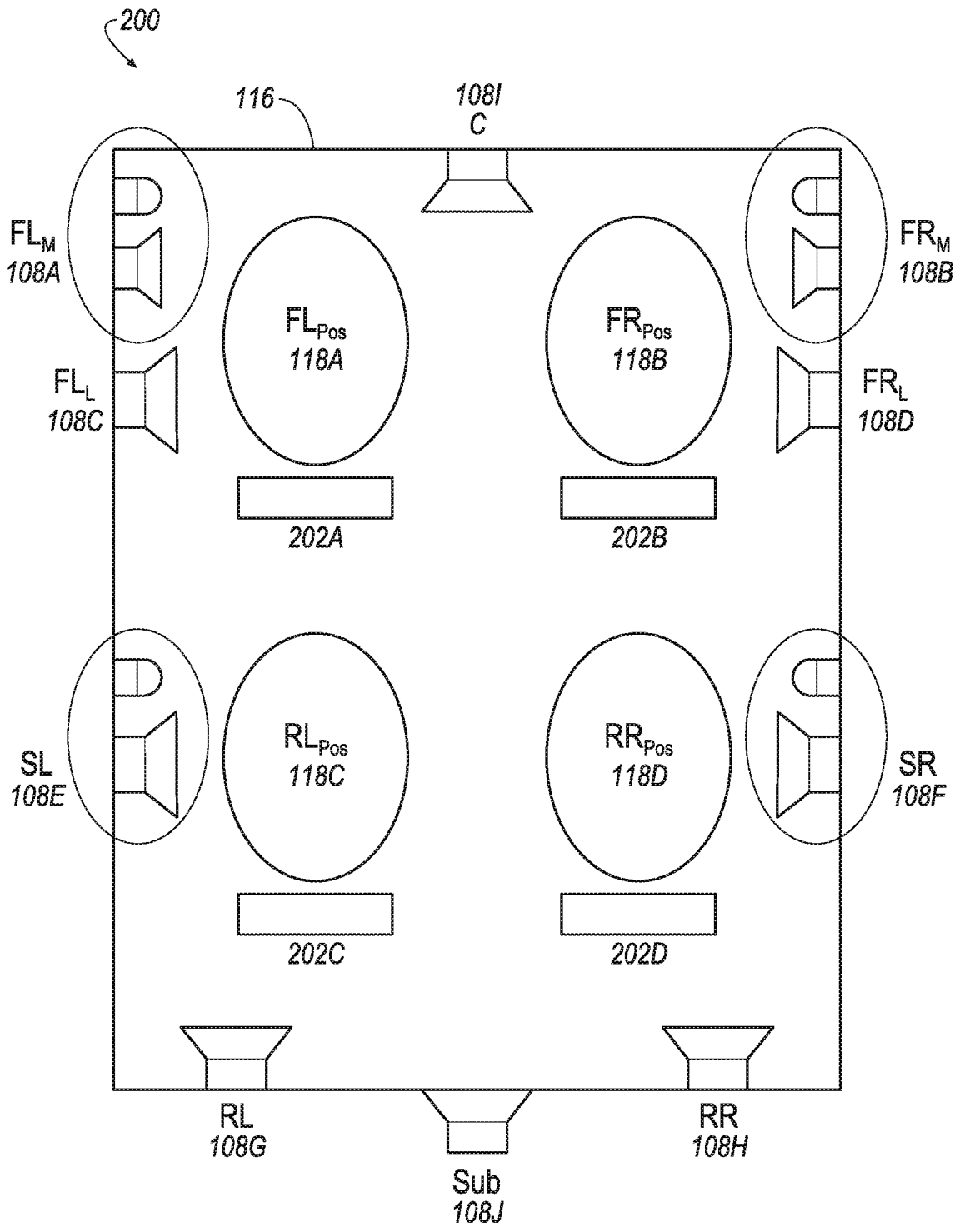
FIG. 2 illustrates a speaker layout of a vehicle, in accordance with one embodiment.

FIG. 2 illustrates an example layout 200 of the audio system 100 in a vehicle interior listening space 116 having ten system speakers 108A-108J (collectively 108) and four sound zones 118A-118D (collectively 118). As shown, these speakers 108 include front-left-mid (FLM) speaker 108A and front-right-mid (FRM) speaker 108B (e.g., passively-coupled tweeters and mid-range speakers in the front doors), front-left-low (FLL) speaker 108C and front-right-low speaker (FRL) 108D (e.g., woofers in the front doors), side-left (SL) speaker 108E/side-left (SR) speaker 108F (e.g., passively-coupled tweeter and woofer in the rear doors), rear-left (RL) speaker 108G/rear-right (RR) speaker 108H (e.g., a mid-range speaker at the hat shelf), center-channel (C) speaker 108I (e.g., a center midrange speaker at the dash board), and subwoofer (Sub) speaker 108J (e.g., a subwoofer speaker at the hat shelf)). The speakers 108 may be arranged at various locations in the vehicle interior listening space 116, the illustrated positions being one example. In addition, four sound zones 118 (e.g., FLPos sound zone 118A, FRPos sound zone 118B, RLPos sound zone 118C, RRPos sound zone 118D) corresponding to four seat positions 202 within the vehicle listening space 116 are depicted.

Figure 3:
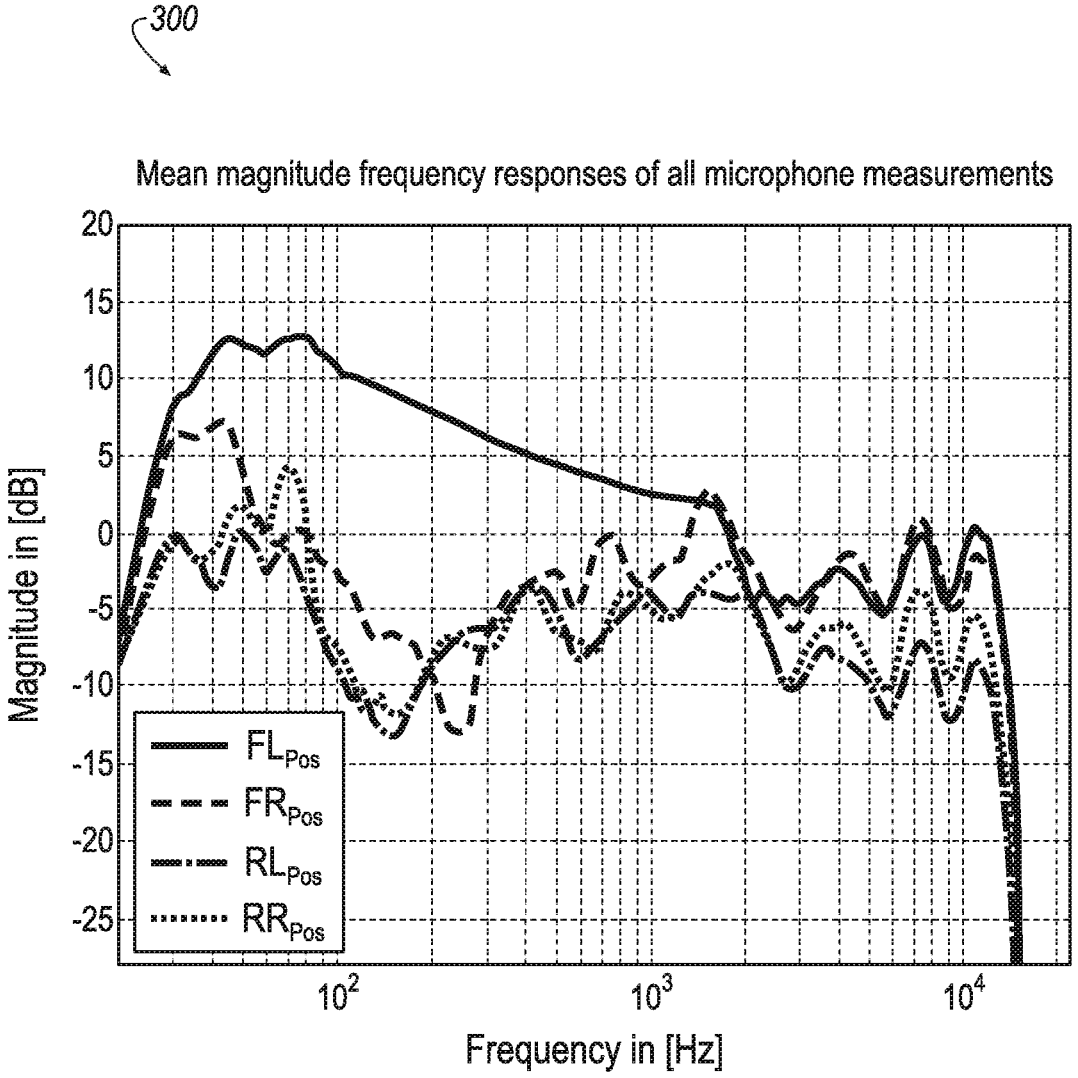
FIG. 3 illustrates an example performance of the speaker layout of FIG. 2, in accordance with one embodiment.

FIG. 3 illustrates an example spectral range performance 300 of the layout 200 using the system speakers 108 illustrated in FIG. 2. The spectral range performance 300 illustrates an acoustical contrast between the bright zone 118A and the three dark zones 118B, 118C, 118D. To create the bright zone 118A and dark zones 118B, 118C, 118D, the system 100 is configured to utilize a pressure matching technique that matches the complex pressures in wavefronts generated by the speakers 108, in a least-squares sense, to reproduce a plane-wave in the bright zone 118A and zero pressure in the dark zones 118B, 118C, 118D. The layout 200 may be configured to utilize the pressure matching technique to deliver better acoustical performance at the bright zone 118A compared to other techniques such as acoustic contrast maximization, beamforming, and high-pass filtering of cylindrical harmonic expansions.

Referring more specifically to the spectral range performance 300, the acoustical contrast between the bright zone 118A and the three dark zones 118B, 118C, 118D illustrates a maximum between $f \approx [100, \ldots, 300]$ [Hz]. Within this spectral range, most or all of the speakers 108 in the examine system 200 may be able to contribute to the creation of the acoustical contrast. In contrast, below $f \approx 100$ [Hz] fewer of the speakers 108 are able to contribute sound energy. For instance, the four door woofer speakers 108C, 108D as well as the subwoofer speaker 108J mounted at the hat shelf may be the speakers 108 of the system 200 able to deliver sufficient sound pressure for creation of acoustical contrast. Hence, bright zone performance may decrease towards low frequencies. One approach to increasing low-frequency bright zone performance may be to increase the quantity of speakers 108 able to contribute in this spectral range. In addition, there is also a maximum upper frequency of $f_{max} \approx 1200$ [Hz] up to which a certain acoustical contrast could be achieved with a speaker 108 setup. A main contributing factor to this limited spectral range is that the distance of the utilized system speakers 108 of the vehicle listening space 116 are too far away from the desired sound zones 118.

One way to enlarge the useful spectral range in which the acoustical contrast can be improved may be to install speakers 108 as close as practically possible to the desired sound zones 118. In vehicle listening space 116, one viable option to do so is to install additional speakers 108 in the headrests of the seats in the sound zones. An alternative option may be to install additional speakers 108 in the vehicle headliner, but since there are convertible vehicles without roofs, such approaches may not always be possible. In addition, distance of the speakers 108 installed to the headliner to the desired sound zones 118 may vary with the seats, since, at least some of the speakers 108 may be adjusted in location and orientation to conform to the dimensions of the seat occupant. Speakers 108 in the headrest would follow those adjustments relative to the seat occupant's head, and thus may remain substantially the same relative distance to the desired sound zones 118. Placing speakers 108 in the headrests may be as close as speakers 108 may be placed to the ears of a listener within a vehicle listening space 116.

Figure 4:
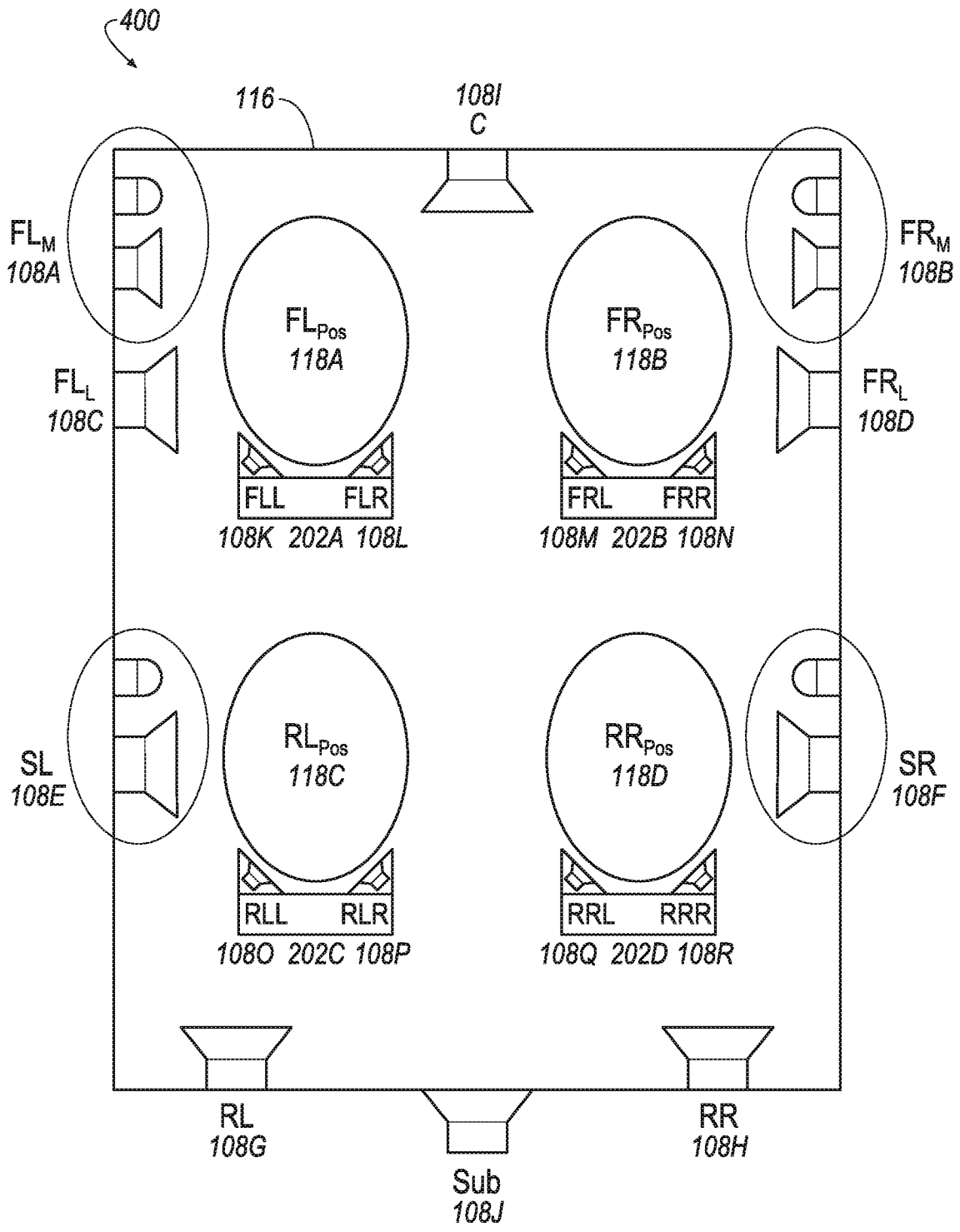
FIG. 4 illustrates an alternate speaker layout of the test vehicle including headrest speakers, in accordance with one embodiment.

FIG. 4 illustrates an alternate layout 400 of the audio system 100 in the vehicle listening space 116 including headrest speakers 108. In the layout 400, as compared to the layout 200, speakers 108 are additionally mounted in all four headrests (two per seat). As shown, a front-left-left (FLL)

speaker 108K and a front-left-right (FLR) speaker 108L are included in the headrest of the sound zone 118A, a front-right-left (FRL) speaker 108M and a front-right-right (FRR) speaker 108N are included in the headrest of the sound zone 118B, a rear-left-left (RLL) speaker 108O and a rear-left-right (RLR) speaker 108P are included in the headrest of the sound zone 118C, and a rear-right-left (RRL) speaker 108Q and a rear-right-right (RRR) speaker 108R are included in the headrest of the sound zone 118D. It should be noted that the alternate layout 400 is only an example, and other layouts including headrest speakers 108 may additionally or alternately be used.

Figure 5:
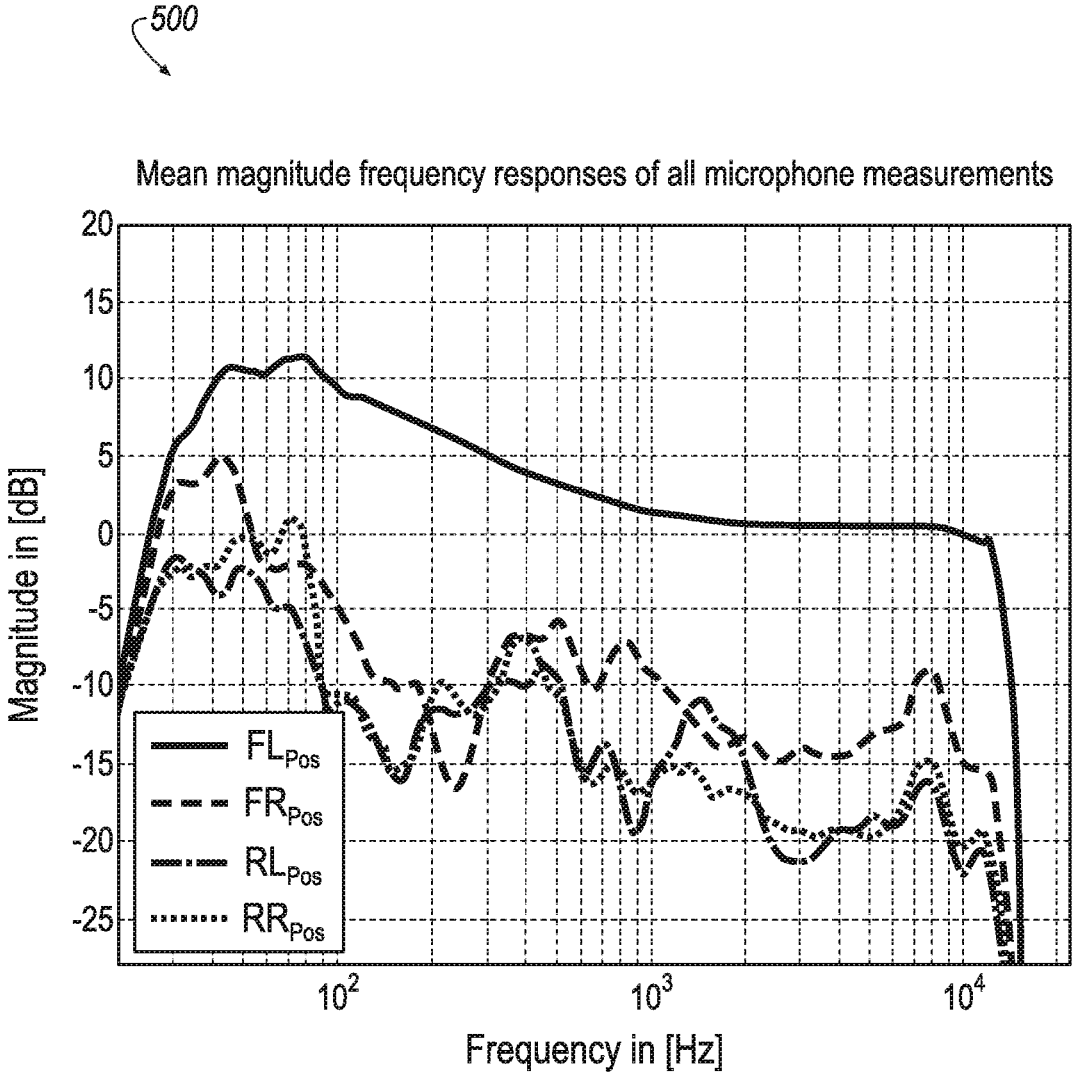
FIG. 5 illustrates an example performance of the alternate speaker layout of FIG. 4, in accordance with one embodiment.

FIG. 5 illustrates an example spectral range performance 500 of the layout 400 using the system speakers 108 illustrated in FIG. 4. Analyzing the performance of the enhanced speaker setup, including the two headrest speakers per seat (e.g., 108K-108R as shown in the layout 400), the headrest speakers 108K-108R may provide a limited improvement to the acoustical contrast below f≈300 [Hz]. This may be due to the physical size of speakers 108K-108R able to be mounted in the headrests being small. Therefore, such speakers 108 may have a relatively high low frequency cut-off In the illustrated performance 500, this cut-off frequency may be estimated to be approximately fcHeadrest≈200 [Hz]. Below the cut-off frequency, the additional headrest speakers 108K-108R may fail to deliver sufficient sound pressure for creation of acoustical contrast, and so no further improvement of the acoustical contrast is made.

At frequencies f>200 [Hz] the positive effect of the headrest speakers 108K-108R is illustrated in the performance 500 by an enlarged useful spectral range. Here, the graphs of FIG. 5 show a combined active and passive damping performance of the headrest speakers 108K-108R. The intersection between the active and passive damping behavior can approximately be seen at the bump in the graphs for the rear left position between f≈[1200, . . . , 2200] [Hz].

Above f≈[1500, . . . , 2500] [Hz] however, minimal, if any, acoustical contrast is possible by utilizing control methods such as the employed sound pressure matching approach. This may be because the speakers 108 in the layout 400 providing output in this frequency range may be unable to come any closer to the desired sound zones 118, as compared to the speakers 108K-118R added to the headrests. Other methods, such as beamforming techniques, use of directional speakers 108 or the like, may be used to improve the acoustical contrast above f>[1500, . . . , 2500] [Hz]. As shown in FIG. 5, the headrest speakers 108K-108R illustrate a substantial degree of directivity above f≈[1500, . . . , 2500] [Hz], which may lead to an acoustical contrast of >10 [dB] between the sound zones 118A, 118B at the front left and front right seats 202 and to a performance of >15 [dB] between the front left sound zone 118A and both sound zones 118C, 118D at the rear seats 202. When using the headrest speakers 118K-118R, not only may the usable bandwidth of the acoustical contrast method be enlarged towards higher frequencies, but also passive damping behavior of the headrest speakers 118K-118R provided by directivity of those speakers 108, may be used to achieve a broadband acoustical contrast improvement covering the whole acoustical spectral range, e.g., up to f≈20 [kHz].

As shown in FIGS. 2-5, headrest speakers 108K-108R may improve performance and enlarge the useful spectral bandwidth. However, with the addition of headrest speakers 108K-108R, influence of delay variations of RIRs between the utilized channels and the desired sound zones 118 to the acoustical performance, especially at the bright zone(s) 118, may require additional consideration.

Acoustical artifacts result during the creation of filter sets used to realize individual sound zones 118. These artifacts may be handled by applying certain constraints within the acoustic contrast control algorithm. How strict those constraints are applied within the utilized control method may depend on the root causes of these acoustical artifacts. In an example, as stricter constraints are applied to fulfill minimum acoustical quality requirements, the lower the finally achievable performance may be. One root cause is related to the properties of the underlying system. For instance, system performance may depend on the number, size, and distribution of the desired, individual sound zones 118, as well as on the number, distribution, and distance of the secondary sources (e.g., speakers 108) to the desired sound zones 118. In an example, a system utilizing secondary sources, distributed along a circle arranged in a regular fashion and where the desired sound zones 118 are located and regularly distributed within the circle, is not prone to create severe acoustical artifacts at the bright zone(s) 118. In contrast, systems with arbitrarily distributed speakers 108, including a high degree of distance variations to the desired sound zones 118, are more likely to produce disturbing acoustical artifacts. A main contributor to this behavior is delay variation.

Figure 6:
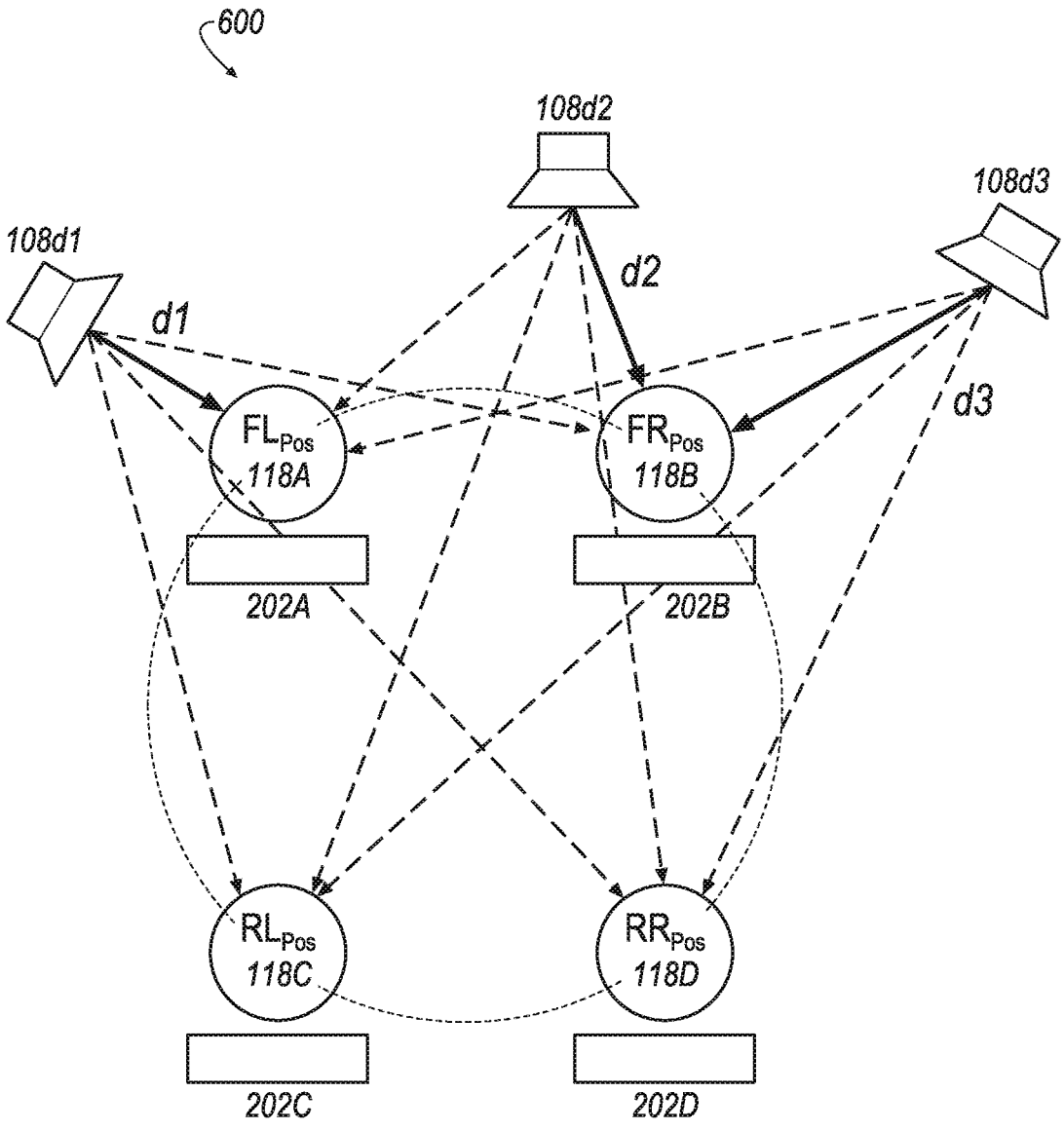
FIG. 6 shows an example of delay variation, in accordance with one embodiment.

FIG. 6 shows an example 600 of delay variation. In the example 600, three speakers 108*d*1, 108*d*2, 108*d*3, generally installed at the front part of the vehicle listening space 116 are depicted, each having a somewhat different minimum distance to a sound zone 118 closest to the respective speaker 108. These minimal distances may be referred to as d1, d2 and d3, with d1<d2<d3.

Notably, there is a relation between the distances of the individual speakers 108 or channels and the sound zones 118 to the individual delays, coupled via the following formula:

$$d=c*td, \text{ where} \tag{1}$$

d=Distance of the speaker to the closest sound zone (e.g., in meters);

c=Speed of sound (e.g., in meters per second); and td=Delay time in (e.g., in seconds).

Using the formula of Eq. 1, the individual delays may be measured or estimated by measuring or estimating the distances of the speakers 108/channels to the sound zones 118. Methods for acoustic propagation delay measurement, and in particular for acoustic distance measurement by measuring the propagation time of acoustic signals, are discussed in further detail in European Patent Application No. EP 2045620, filed Sep. 26, 2007, titled "Acoustic propagation delay measurement," which is incorporated by reference herein in its entirety.

As shown, speaker 108*d*1 is closest to sound zone 118A with the distance of d1, speaker 108*d*2 is closest to sound zone 118B with the distance of d2, and speaker 108*d*3 is closest to the sound zone 118B with a distance of d3. All other distances between the speakers 108*d*1, 108*d*2, 108*d*3 to the remaining, desired sound zones 118, are illustrated with dashed lines with arrows, and are not considered in the following analysis. This is because a delay compensation exceeding the minimum delay of a secondary source to all desired sound zones 118 may lead to an acausal system, which could not be used as data basis for the acoustical contrast control algorithm.

The minimum dmin of all minimal distances d1, d2, d3 (here dmin=d1), may be referred to as a bulk delay. The bulk delay may be extracted from all measured RIR's without risk prior to using the RIR as inputs for the control algorithm. Thus, the ISZ filters do not require modification if the bulk delay is removed from the original RIR's, prior to the calculation of the ISZ filter.

Figure 7:
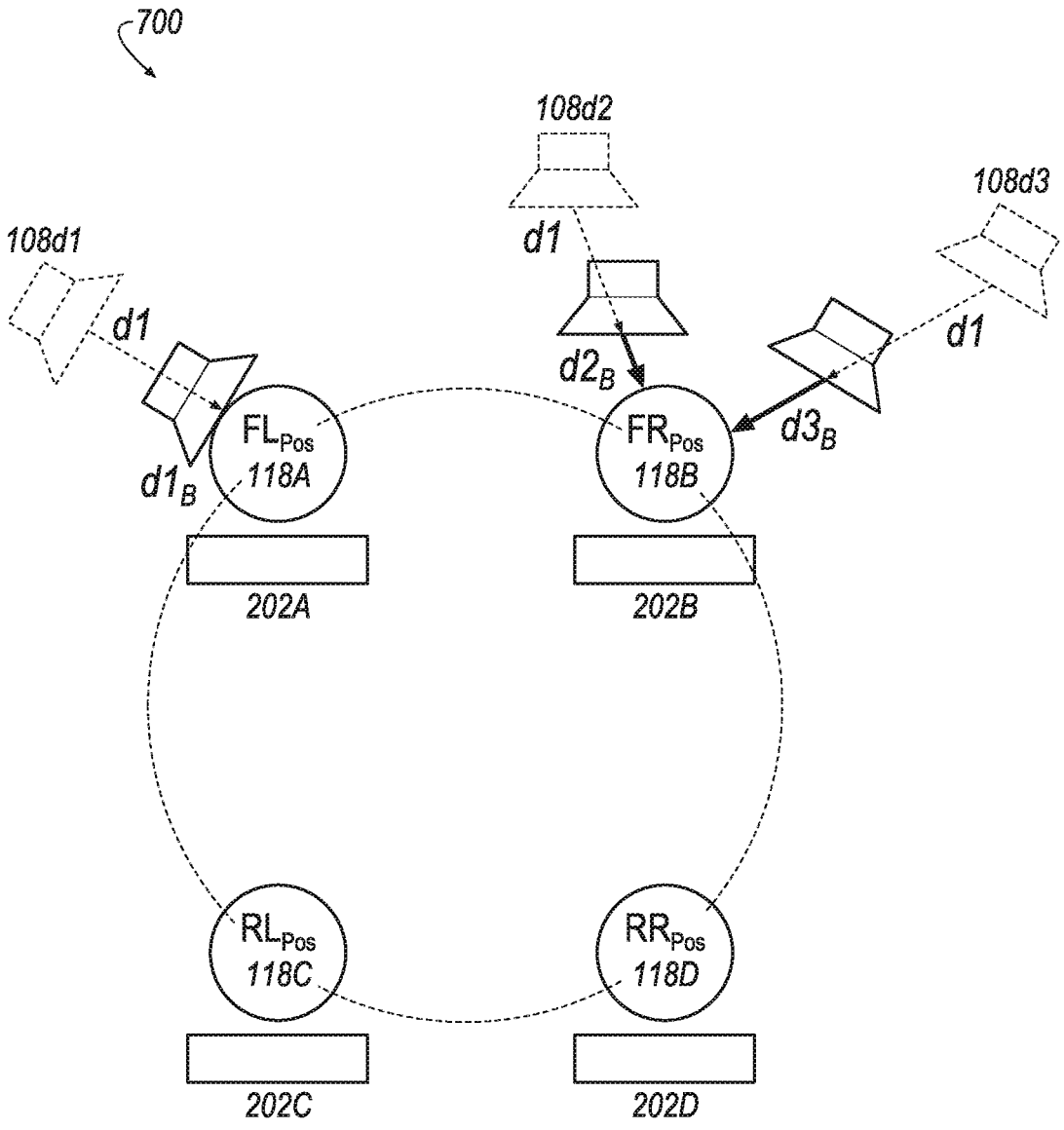
FIG. 7 illustrates a delay compensation example including a bulk delay reduction, in accordance with one embodiment.

FIG. 7 illustrates an example 700 of the delay variation shown in the example 600, with the bulk delay having been extracted from the RIR's. For the resulting distances, and therefore respective delays, the following relationship may be stated: d1B=dmin=0<d2B=d2−d1<d1B=d3−d1. The delay for speaker 108*d*1, the closest speaker, is now substantially zero. For the speakers 108*d*2 and 108*d*3, reduced minimum virtual distances of d2B and d3B, respectively, remain, after subtraction of the bulk delay of all RIR's, e.g., the entire delay from the closest speaker 108*d*1.

Figure 8:
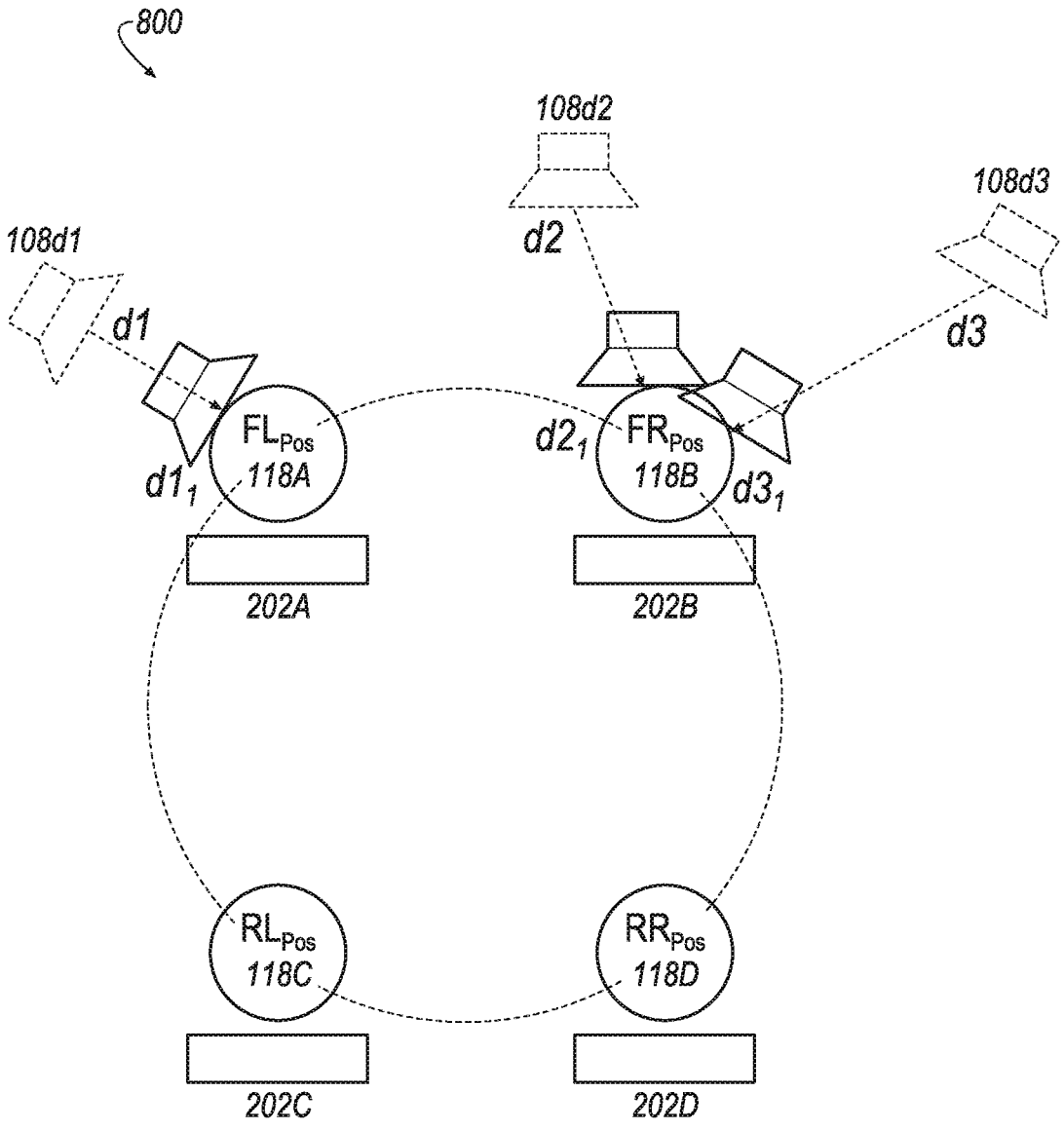
FIG. 8 illustrates a delay compensation example including individual delay compensation, in accordance with one embodiment.

FIG. 8 illustrates an example 800 of individual delay compensation for the sound zones 118. Referring to the example 800, after applying an individual delay compensation as shown in the example 700, the remaining, minimum distances (dxI, with x=number of speaker) are reduced to zero. For our example, this means: d1I=d2I=d3I=0. This represents the maximal possible, causal delay extraction.

However, in contrast to pure compensation of the bulk delay, if individual delay compensation is applied to all RIR's prior to the calculation of the ISZ filter, the resulting filter is unable to be applied to the playback system without further modification. This is because by cutting of the individual delays, the original relative distances between the desired sound zones 118 and the positions of the speakers 108 becomes virtually shifted. After compensation of the individual delays, the relative distances between the new, virtual speaker positions and the desired sound zones 118 are set to zero, and thus are all the same. Thus, to use the ISZ filter, resulting after a prior compensation of the individual delays, this situation has to be replicated, i.e., the distances of all speakers 108 to the desired sound zones 118, have to be the same. The minimum delays, which are able to fulfill this prerequisite, can generally be calculated as follows:

$$dnw=(zd\max-dn),$$

with:

dnw=Distance, respective delay, which has to be applied to the nth ISZ filter wn [k], $$wn[k]=\text{ISZ filter of the nth channel in the time domain}, \quad (2)$$

n=Number of the speaker, respective reproduction channel (n=[1, . . . , N], where N=Maximal number of channels), k=Discrete time index, dmax=Maximum value of all minimum distances from the speakers to the desired sound zones (dn, with n=[1, . . . , N]).

Applied to the example, the ISZ filter wn[k] may be delayed as follows:

$$d1w=d3-d1,$$

$$d2w=d3-d2,$$

$$d3w=0, \quad (3)$$

with dmax=d3.

Figure 9:
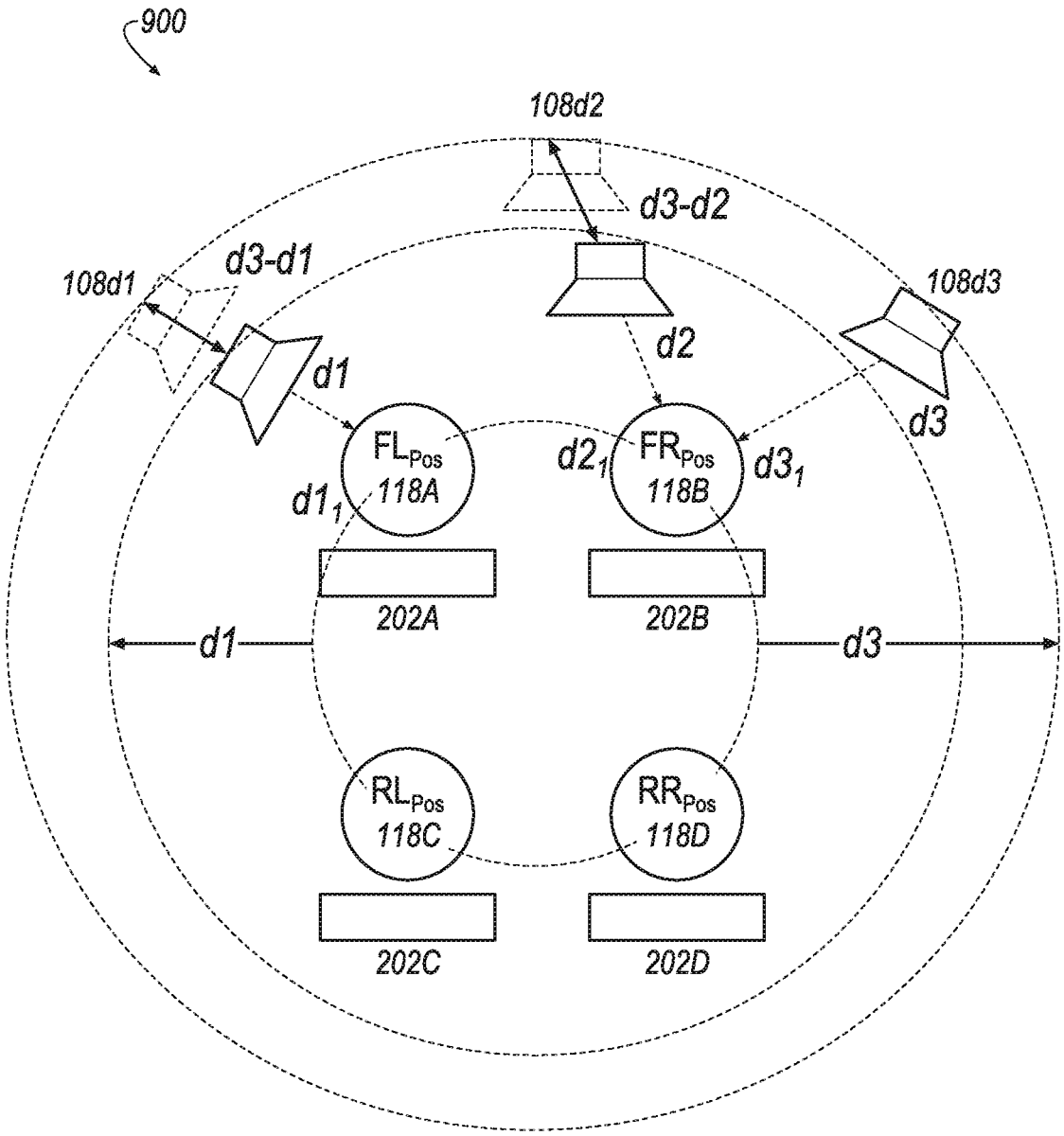
FIG. 9 illustrates delay insertion for the playback system after prior application of individual delay compensation, in accordance with one embodiment.

FIG. 9 illustrates the previously-described delay adjustment principle regarding minimum delay compensation. The minimum delays dnw, which may be applied to the resulting ISZ filter wn[k] after a prior application of an individual delay compensation, are based on the relative, minimum distances between the original speaker positions and the desired sound zones dmax−dn. Hence, individual delay compensation may be recommended, if the relative minimum distances between the original speaker 108 positions and the desired sound zones 118 show a large dynamic range. The layout 400 demonstrates such a situation. In the layout 400, some of the speakers 108 (e.g., 108K-108R) are relatively close to the desired sound zones 118, while other speakers 108 (e.g., 108A-108L) are much further away. For a vehicle listening space 116, if speakers 108 are included in close proximity to the desired sound zones 118, such as speakers 108 in the headrest and/or installed in the headliner, individual delay compensation may be beneficial in the provisioning of individual sound zones 118.

Figure 10:
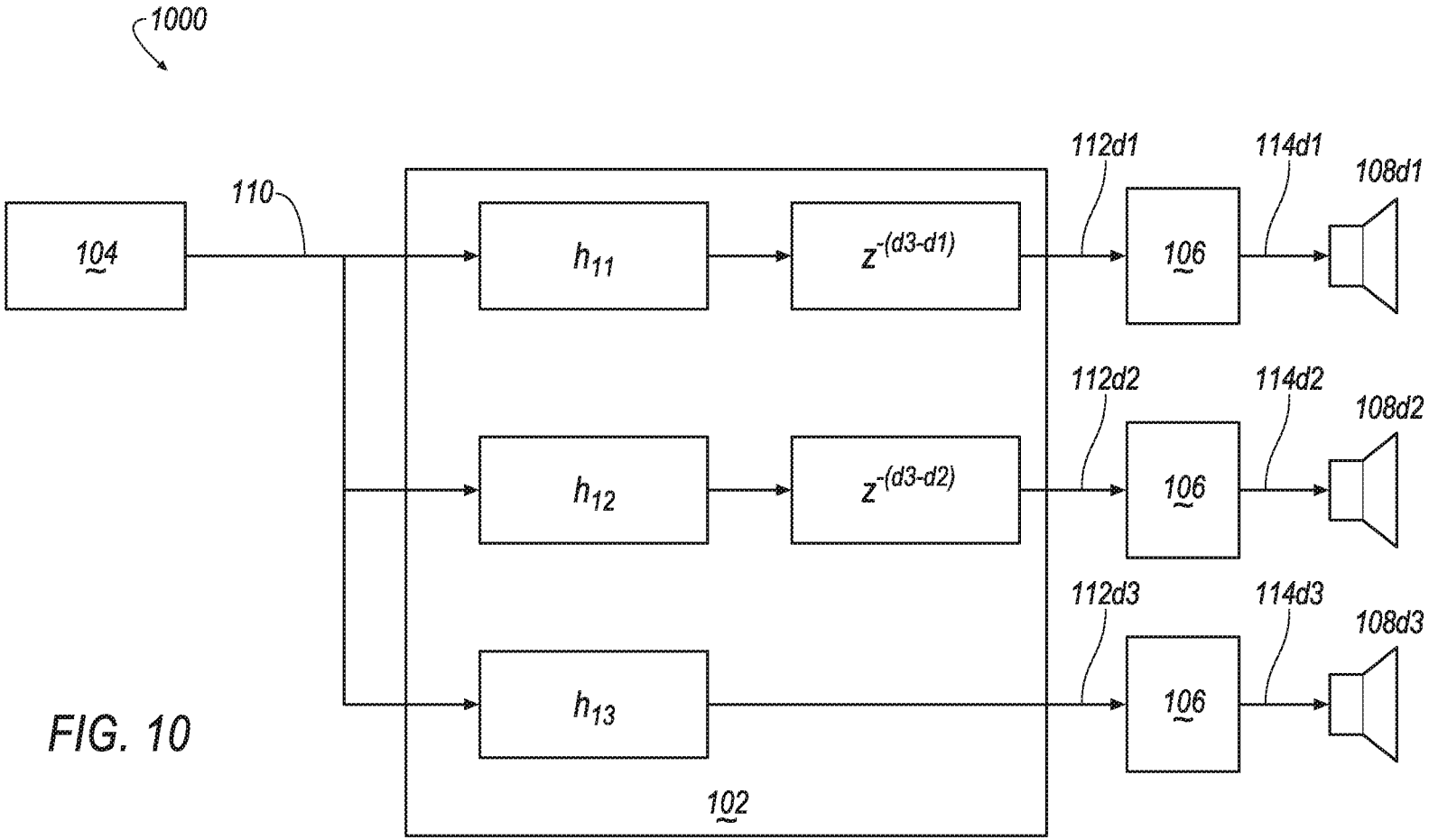
FIG. 10 illustrates an example of signal processing performed by the audio processing system in support of the providing delay-adjusted signals to the speakers, in accordance with one embodiment.

FIG. 10 illustrates an example 1000 of signal processing performed by the audio processing system 102 in support of the providing delay-adjusted signals to the speakers 108. As shown, the audio source 104 provides audio input channels 110 including zone audio to the audio processing system 102. The audio processing system 102 uses the audio processor 120 to process the audio input channels 110 into audio output signals 112 to send to the amplifiers 106. The amplifiers 106 in turn provide amplified audio output signals 112 to the speaker connections 114 of the speakers 108.

More specifically, the audio processor 120 of the audio processing system 102 is configured to first generate audio signals corresponding to each speaker 108 in support of the zone audio. In an example, the zone audio signal may be generated using a multiple-input multiple-output (MIMO) system. The MIMO system may implement finite impulse response (FIR) filters generated by a pressure matching, filtered-X least mean square (FxLMS) algorithm. The audio processor 120 may further delay the generated zone audio signals in accordance with the previously-described delay adjustment. Continuing with the example discussed above, the speaker 108*d*1 is delayed by d1*w*=d3−d1, the speaker 108*d*2 is delayed by d2*w*=d3−d2, and the speaker 108*d*3 is delayed by d3*w*=0 (as dmax=d3).

Benefits of individual delay compensation, in contrast to a pure extraction of the bulk delay, may be shown by example. Based on measurements carried out in the vehicle listening space 116 equipped with headrest speakers 108 at the seat positions 202, two simulations, utilizing the sound pressure matching method, were conducted. In a first simulation, the bulk delay may be considered prior to the calculation of the ISZ filter, as this delivers similar results to if no delay compensation were applied due to the close distance of the headrest speakers 108 to the desired sound zones 118. This result is shown in the example spectral range performance 500 of the layout 400 discussed above. In a second simulation, the individual delay compensation may be applied, utilizing the same acoustical control method, measurement data, and parameterization of the ISZ algorithm.

Figure 11:
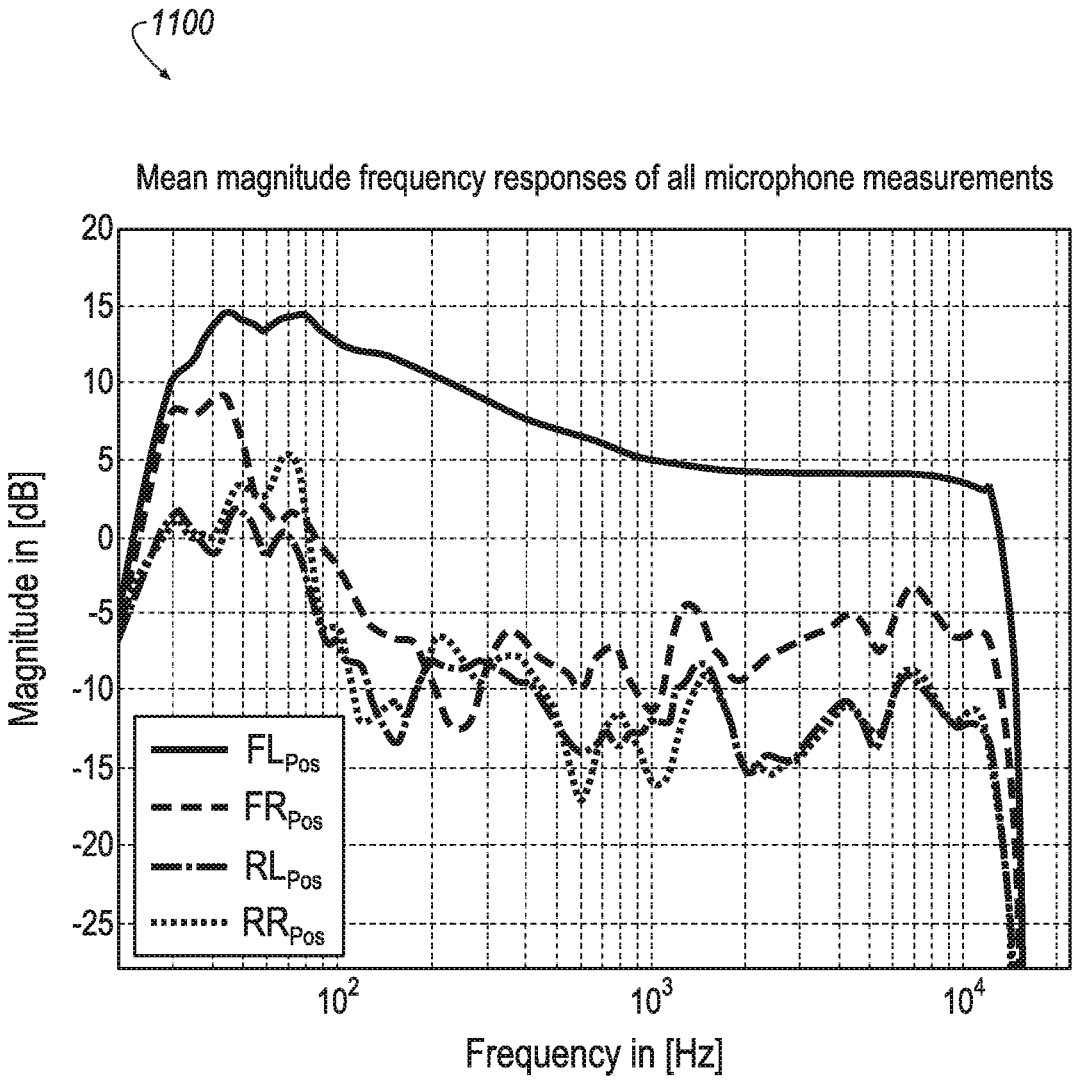
FIG. 11 illustrates an example performance of the alternate speaker layout using the individual delay compensation, in accordance with one embodiment.

FIG. 11 illustrates an example spectral range performance 1100 of the layout 400 using the system speakers 108 illustrated in FIG. 4 with individual delay compensation. Comparing the spectral range performance 500 with the spectral range performance 1100, it can be seen that the difference in performance acoustical contrast is minimal. For instance, the difference in acoustic contrast between the spectral range performance 500 and the spectral range performance 1100 is much less than the difference in acoustic contrast between the spectral range performance 500 and the spectral range performance 300. Accordingly, application of individual delay compensation does not impair the reachable, acoustical contrast that is attainable using a system including headrest speakers 108 such as that described above in the layout 400.

Acoustic tests in the vehicle listening space 116 at the bright zone(s) 118 may illustrate that the ISZ filter, which results from the use of the individual delayed compensation method, shows a clear acoustical improvement over an ISZ filter resulting from the use of the bulk delay compensation method during its calculation. A main difference of using the individual delay compensation instead of the bulk delay compensation may be described as a missing or reduced hissing sound, which may be perceivable to a listener, e.g., after percussive stimuli.

The acoustical effect of using individual delayed compensation instead of bulk delay compensation may be visualized and retrospectively objectified in various methods. These analysis methods may be used to illustrate the acoustical improvement between the bulk and individualized delay compensation methods. For simplicity and sake of explanation, the ISZ filters of the center channels (e.g., driving the speaker 1081) were used. The results may vary for use of other channels, as some channels show a higher contribution then others, but in general all channels showed an acoustical improvement, when using the individual delay compensation method within the acoustical contrast control algorithm.

Figure 12:
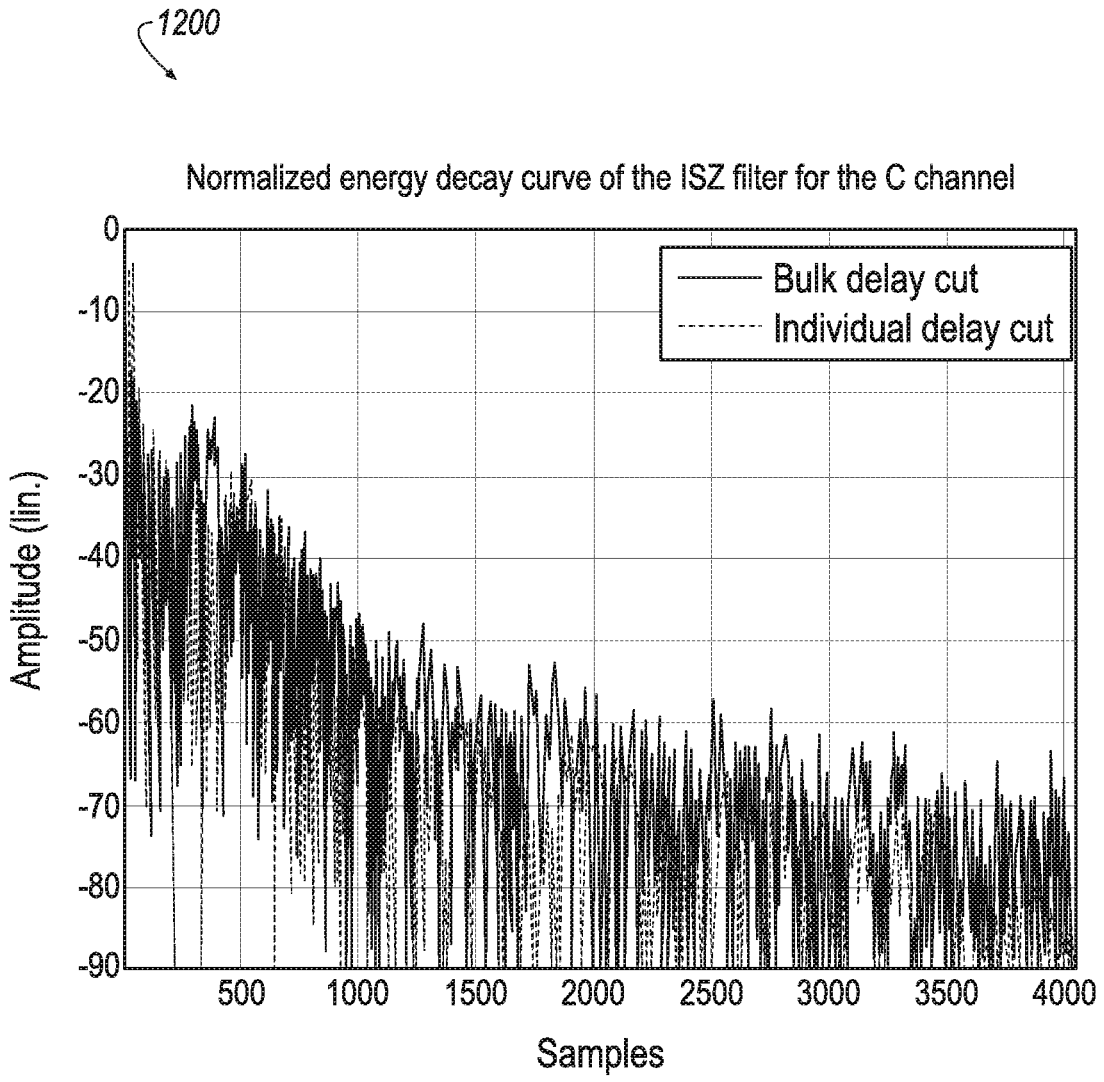
FIG. 12 illustrates an example energy decay curve of the individual sound zone filter for the center channel, calculated with bulk as well as with individual delay compensation, in accordance with one embodiment.
Figure 13:
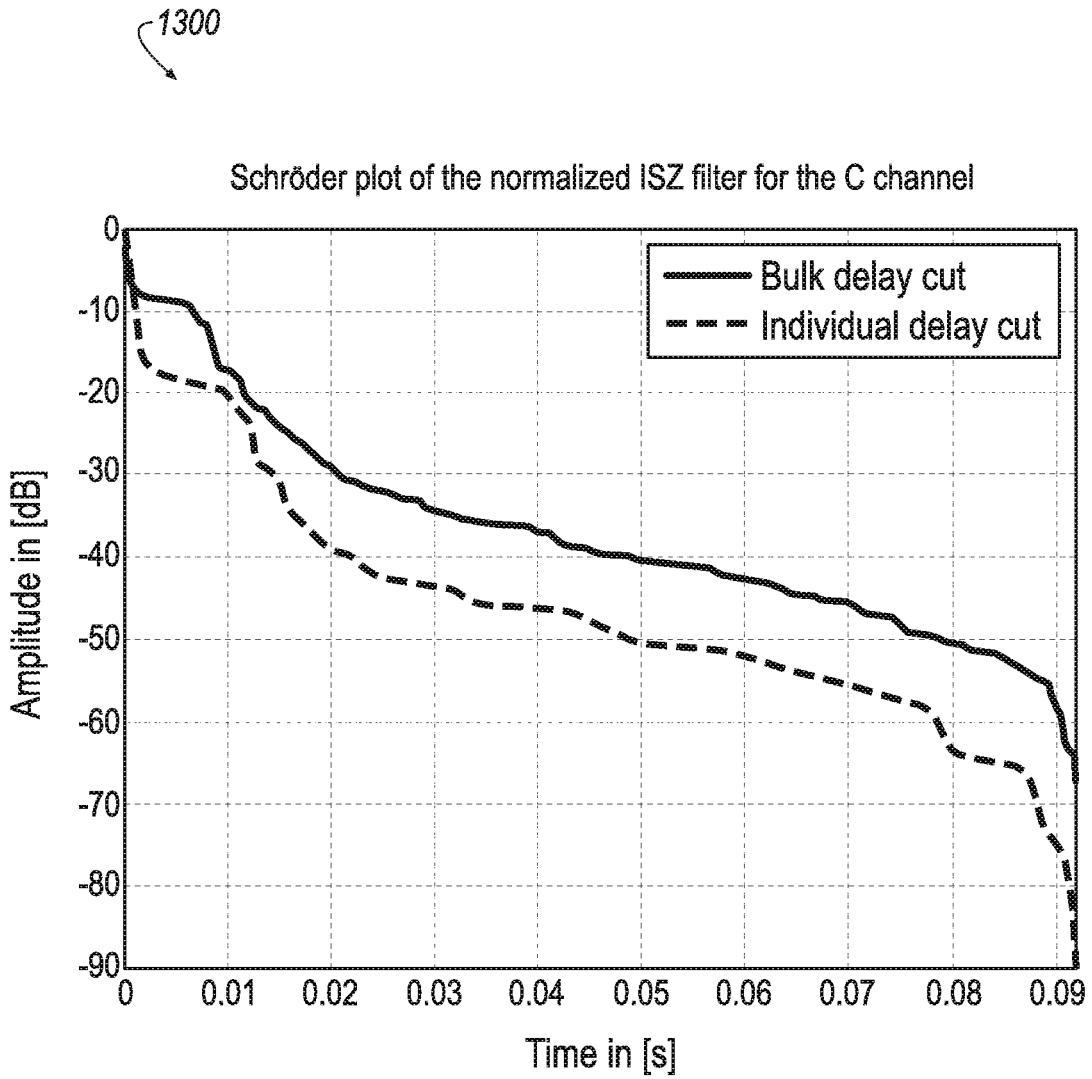
FIG. 13 illustrates an example Schroder plot of the individual sound zone filter for the center channel, calculated with bulk as well as with individual delay compensation, in accordance with one embodiment.
Figure 14:
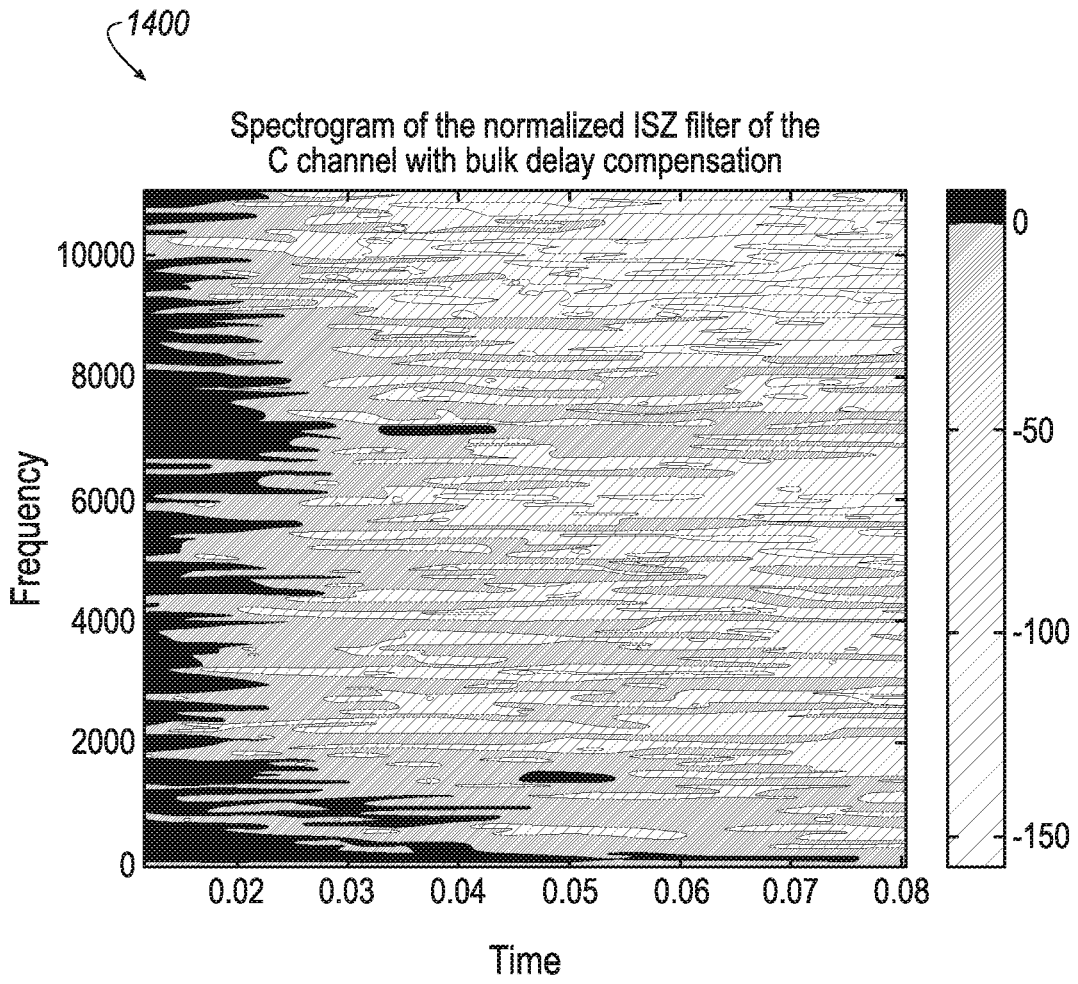
FIG. 14 illustrates an example spectrogram of the individual sound zone filter for the center channel, calculated with bulk delay compensation, in accordance with one embodiment.
Figure 15:
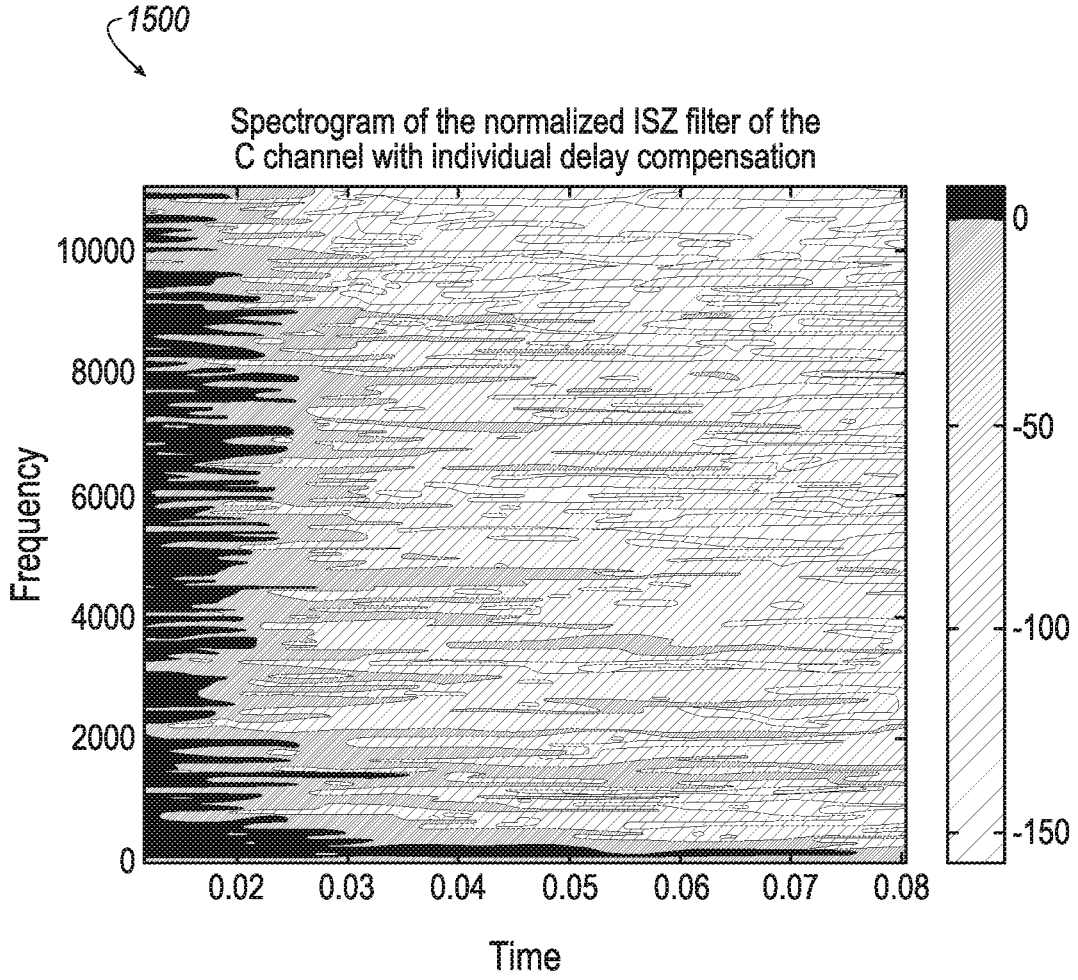
FIG. 15 illustrates an example spectrogram of the individual sound zone filter for the center channel, calculated with individual delay compensation, in accordance with one embodiment.

FIG. 12 illustrates an example energy decay curve (EDC) 1200 for bulk delay compensation in comparison to individual delay compensation. As shown, the resulting ISZ filter was normalized to one, respectively to 0 [dB], before comparing the results. The normalizing of the ISZ filter may be performed to aid in illustration of the range the acoustical improvement. The acoustical improvement is shown in the time domain in the EDC 1200 plot of FIG. 12, and within a Schroder plot 1300 as depicted in FIG. 13. The acoustical improvement is also shown in the spectral domain via a spectrogram 1400 of the bulk compensation illustrated in FIG. 14, in comparison to a spectrogram 1500 of the individual delay compensation illustrated in FIG. 15.

The EDC plot 1200 and the Schroder plot 1300 each illustrate that the ISZ filter, for the center channel resulting from individual delay compensation, provides less energy reverberation over time as compared to use of bulk delay compensation.

Referring to the corresponding spectrograms 1400 and 1500 of the two normalized ISZ filters, further information may be identified. It can be seen from the spectrograms 1400 and 1500 that certain frequency ranges contribute to the reduction of the reverberant energy. For instance, it be seen that the spectral range of $f \approx [0.5, \ldots, 10]$ [kHz] is most affected by the energy reduction over time. This frequency range is well within the acoustical range of human hearing, e.g., showing a high degree of sensitivity as would be identified from loudness curves. Accordingly, this acoustical improvement in the mid and high spectral areas may result in the reduction in unnatural hissing sounds.

Figure 16:
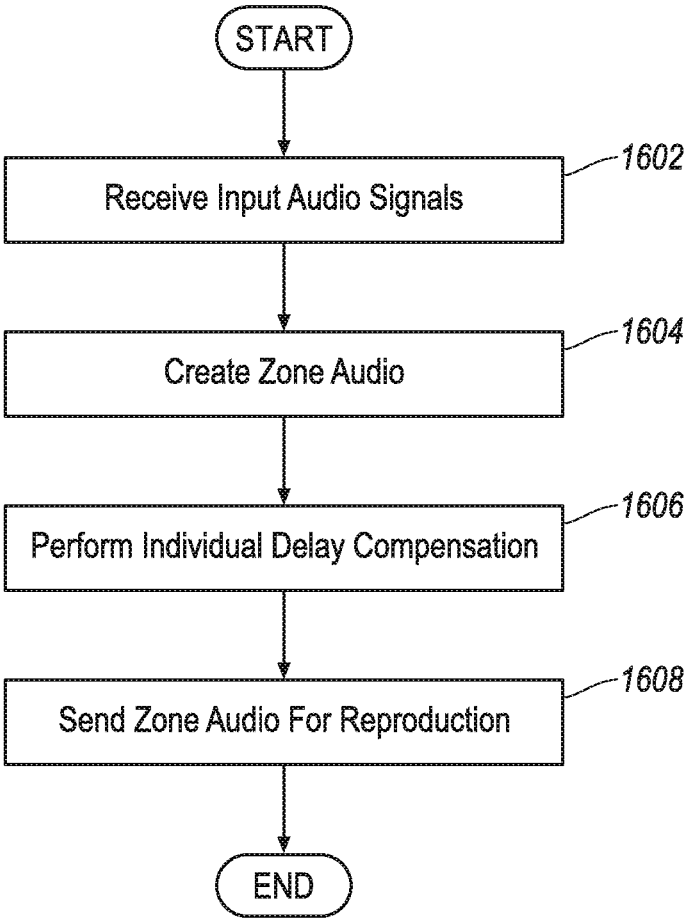
FIG. 16 illustrates an example process for performing individual delay compensation, in accordance with one embodiment.

FIG. 16 illustrates an example process 1600 for performing individual delay compensation. In an example, the process 1600 may be performed by the system 100 in an environment such as that shown in the layouts 200 or 400.

At operation 1602, the audio processor 120 receives audio input channels 110 from an audio source 104. In an example, the audio input channels 110 may be audio received from a radio receiver or from a media player.

At operation 1604, the audio processor 120 creates zone audio signals. In an example, the audio processor 120 utilizes the ISZ filter sets to generate the bright and dark zone outputs. For instance, the zone audio signals may be generated by the audio processor 120 using a MIMO system implementing FIR filters designed according to a pressure matching FxLMS algorithm.

At operation 1606, the audio processor 120 performs individual delay compensation. In an example, the audio processor 120 adds delay to outputs of the ISZ filter to further delay the generated audio signals in accordance with the previously-described delay adjustments. The additional delays may adjust the output of one or more of the speakers 108 to match an amount of delay of a most-delayed speaker 108 to the plurality of sound zones 118. In many examples, the individual delays are pre-calculated offline together with the ISZ filter set(s). However, in other examples the audio processor 120 may determine at runtime the additional delay for a first of the speakers 108 by subtracting an individual delay of the first of the speakers 108 from the delay of the most delayed speaker 108. The audio processor 120 may also determine the additional delay for a second of the speakers 108 by subtracting an individual delay of the second speaker 108 from the delay of the most delayed speaker 108. To identify the delay amounts, the audio processor 120 may access preconfigured individual delay data from the memory 122.

At operation 1608, the audio processor 120 sends the zone audio signals for reproduction. In an example, the audio processor 120 provides the audio output channels 112 to one or more amplifiers 106, which in turn, provide the amplified signals to the speaker connections 114 of the speakers 108. Accordingly, the individual delay adjusted audio is provided to the sound zones 118 of the listening space 116. After operation 1608, the process 1600 ends.

Accordingly, by applying an individual delay compensation which includes an a priori cut of individual minimum channel delays in respect to the desired sound zones 118, as well as an a posteriori insertion of delays into the ISZ filter resulting from an acoustical contrast algorithm delivering one filter per involved channel, the system is able to desirably improve the acoustical performance at the bright zone(s) 118 without negatively affecting the performance of the acoustical contrast. Examples discussed herein are based on an application within the automotive environment, having special properties, as, for example, the locations of the sound zones 118 are predefined as they correspond with the seat positions 202 and because many speakers 108 used in the creation of the personal sound zones 118 are also at predefined positions within the vehicle interior listening space 116. Also, the importance of having speakers 108 in close proximity to the desired sound zones 118 in order to increase the useful spectral range in which the acoustical contrast shows a good performance was discussed. It should be noted that systems such as the layout 400 having variations of the distances between speakers 108 and sound zones 118, and thus also of the individual delays between the engaged speakers 108 and the desired sound zones 118, is a justification for the disclosed individual delay compensation method.

Computing devices described herein, such as the audio processing system 102, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a plurality of speakers arranged within a listening space; and an audio processor configured to generate a plurality of sound zones within the listening space using the plurality of speakers, the audio processor programmed to perform individual delay compensation to audio input channels to create a plurality of delay-compensated audio input channels, the individual delay compensation configured to adjust relative timing of acoustical output from the plurality of speakers to remove respective delays of each of the plurality of speakers to the plurality of sound zones, create zone audio signals to generate at least one bright zone in the plurality of sound zones using the plurality of delay-compensated audio input channels as adjusted per the individual delay compensation, perform delay insertion to the zone audio signals to add additional delay to a subset of the plurality of speakers, the additional delay defined to adjust relative timing of acoustical output from the subset of the plurality of speakers to match an amount of delay of a most-delayed speaker of the plurality of speakers to the plurality of sound zones, and transmit the zone audio signals to reproduce the at least one bright zone by the plurality of speakers.

2. The system of claim 1, wherein the audio processor is further programmed to retrieve predefined information indicative of amounts of the delay insertion from a memory.

3. The system of claim 1, wherein the audio processor is further programmed to determine the additional delay for a first of the plurality of speakers by subtracting an individual delay of the first of the plurality of speakers from the delay of the most delayed speaker, and determine the additional delay for a second of the plurality of speakers by subtracting an individual delay of the second of the plurality of speakers from the delay of the most delayed speaker.

4. The system of claim 1, wherein the audio processor is further programmed to generate the zone audio signals using a multiple-input multiple-output (MIMO) system implementing finite impulse response (FIR) filters.

5. The system of claim 4, wherein the FIR filters are generated according to a pressure matching, filtered-X least mean square (FxLMS) algorithm.

6. The system of claim 1, wherein the listening space is a cabin of a vehicle, and the plurality of speakers includes speakers mounted about a perimeter of the cabin and to seat headrests of the vehicle.

7. The system of claim 1, further comprising:

an audio source configured to provide audio input signals to the audio processor; and an amplifier configured to receive the zone audio signals from the audio processor, amplify the zone audio signals, and provide the zone audio signals as amplified to the plurality of speakers.

8. A method comprising:

receiving audio input channels from an audio source to be provided to a plurality of speakers arranged within a listening space to support a plurality of sound zones;

performing individual delay compensation to the audio input channels to create a plurality of delay-compensated audio input channels, the individual delay compensation adjusting relative timing of acoustical output from the plurality of speakers to remove respective delays of each of the plurality of speakers to the plurality of sound zones;

creating zone audio signals to generate at least one bright zone in the plurality of sound zones using the plurality of delay-compensated audio input channels as adjusted per the individual delay compensation;

performing delay insertion to the zone audio signals to add additional delay to a subset of the plurality of speakers, the additional delay adjusting relative timing of acoustical output from the subset of the plurality of speakers to match an amount of delay of a most-delayed speaker of the plurality of speakers to the plurality of sound zones; and transmitting the zone audio signals for reproduction by the plurality of speakers.

9. The method of claim 8, further comprising retrieving predefined information indicative of amounts of the delay insertion from a memory.

10. The method of claim 8, further comprising determining the additional delay for a first of the plurality of speakers by subtracting an individual delay of the first of the plurality of speakers from the delay of the most delayed speaker; and determining the additional delay for a second of the plurality of speakers by subtracting an individual delay of the second of the plurality of speakers from the delay of the most delayed speaker.

11. The method of claim 8, further comprising generating the zone audio signals using a multiple-input multiple-output (MIMO) system implementing finite impulse response (FIR) filters.

12. The method of claim 8, wherein the FIR filters are designed according to a pressure matching, filtered-X least mean square (FxLMS) algorithm.

13. The method of claim 8, wherein the listening space is a cabin of a vehicle, and the plurality of speakers includes speakers mounted about a perimeter of the cabin and to seat headrests of the vehicle.

14. The method of claim 8, wherein the plurality of sound zones includes at least one bright zone and one or more dark zones.

15. A computer-program product embodied in a non-transitory computer-readable medium, the computer-program product comprising instructions to cause an audio processor to:

receive audio input channels from an audio source to be provided to a plurality of speakers arranged within a listening space to provide a plurality of sound zones;

perform individual delay compensation to the audio input channels to create a plurality of delay-compensated audio input channels, the individual delay compensation configured to adjust relative timing of acoustical output from the plurality of speakers to remove respective delays of each of the plurality of speakers to the plurality of sound zones;

create zone audio signals to generate at least one bright zone in the plurality of sound zones using the plurality of delay-compensated audio input channels as adjusted per the individual delay compensation;

perform delay insertion to the zone audio signals to add additional delay to a subset of the plurality of speakers, the additional delay being defined to adjust is relative timing of an acoustical output from the subset of the plurality of speakers to match an amount of delay of a most-delayed speaker of the plurality of speakers to the plurality of sound zones; and transmit the zone audio signals for reproduction by the plurality of speakers.

16. The computer-program product of claim 15, further comprising instructions that, when executed by the audio processor, cause the audio processor to retrieve predefined information indicative of amounts of the delay insertion from a memory.

17. The computer-program product of claim 15, further comprising instructions that, when executed by the audio processor, cause the audio processor to:

determine the additional delay for a first of the plurality of speakers by subtracting an individual delay of the first of the plurality of speakers from the delay of the most delayed speaker; and determine the additional delay for a second of the plurality of speakers by subtracting an individual delay of the second of the plurality of speakers from the delay of the most delayed speaker.

18. The computer-program product of claim 15, further comprising instructions that, when executed by the audio processor, cause the audio processor to generate the zone audio signals using a multiple-input multiple-output (MIMO) system implementing finite impulse response (FIR) filters.

19. The computer-program product of claim 18, wherein the FIR filters are designed according to a pressure matching, filtered-X least mean square (FxLMS) algorithm.

20. The computer-program product of claim 15, wherein the listening space is a cabin of a vehicle, and the plurality of speakers includes speakers mounted about a perimeter of the cabin and to seat headrests of the vehicle.

* * * * *